US007719200B2

(12) United States Patent
Laroussi

(10) Patent No.: US 7,719,200 B2
(45) Date of Patent: May 18, 2010

(54) PLASMA GENERATOR

(75) Inventor: Mounir Laroussi, Virginia Beach, VA (US)

(73) Assignee: Old Dominion University, Norfolk, VA (US)

( * ) Notice: Subject to any disclaimer, the term of this patent is extended or adjusted under 35 U.S.C. 154(b) by 423 days.

(21) Appl. No.: 11/885,840

(22) PCT Filed: Mar. 7, 2006

(86) PCT No.: PCT/US2006/008080

§ 371 (c)(1),
(2), (4) Date: Sep. 7, 2007

(87) PCT Pub. No.: WO2006/096716

PCT Pub. Date: Sep. 14, 2006

(65) Prior Publication Data

US 2009/0121637 A1 May 14, 2009

Related U.S. Application Data

(60) Provisional application No. 60/659,365, filed on Mar. 7, 2005, provisional application No. 60/691,852, filed on Jun. 17, 2005.

(51) Int. Cl.
*H01J 7/24* (2006.01)

(52) U.S. Cl. ..... 315/111.81; 315/111.21; 219/121.36; 219/121.48; 219/121.52; 219/121.51

(58) Field of Classification Search ..... 315/111.21, 315/111.51, 111.81, 111.41, 111.71; 219/121.36, 219/121.48, 121.5, 121.51, 121.52; 313/231.31
See application file for complete search history.

(56) References Cited

U.S. PATENT DOCUMENTS

| | | | | |
|---|---|---|---|---|
| 5,977,715 | A * | 11/1999 | Li et al. | 315/111.81 |
| 7,271,363 | B2 * | 9/2007 | Lee et al. | 219/121.52 |
| 7,603,963 | B2 * | 10/2009 | Ripley et al. | 118/723 E |
| 2006/0028145 | A1 * | 2/2006 | Mohamed et al. | 315/111.21 |
| 2009/0142514 | A1 * | 6/2009 | O'Neill et al. | 427/595 |

* cited by examiner

*Primary Examiner*—Douglas W Owens
*Assistant Examiner*—Ephrem Alemu
(74) *Attorney, Agent, or Firm*—Bowman Green Hampton & Kelly, PLLC

(57) ABSTRACT

A plasma generator, comprising a dielectric tube having a first end and a second end, wherein the first end is sealed, but for a gas inlet; at least one first dielectric disk located within the dielectric tube, wherein the first dielectric disk includes at least one first dielectric aperture formed therein; a first ring electrode that at least partially surrounds the at least one first dielectric aperture and is electrically coupled to a power supply; at least one second dielectric disk located proximate the second end of the dielectric tube, wherein the second dielectric disk includes at least one second dielectric aperture formed therein; and a second ring electrode that at least partially surrounds the at least one second dielectric aperture and is electrically coupled to the power supply. During use, the plasma generator produces at least one plasma plume that is launched into open air.

23 Claims, 4 Drawing Sheets

PLASMA GENERATOR

CROSS-REFERENCE TO RELATED APPLICATIONS

This nonprovisional patent application claims the benefit of U.S. Provisional Patent Application Ser. No. 60/659,365, filed Mar. 7, 2005, and U.S. Provisional Patent Application Ser. No. 60/691,852, filed Jun. 17, 2005, the disclosures of which are incorporated herein by reference.

BACKGROUND OF THE INVENTION

Field of the Invention

This invention is drawn generally to plasma generators. In particular, the present invention is drawn to a plasma generator capable of producing a plasma plume or jet in open room air.

SUMMARY OF THE INVENTION

The present invention relates generally to plasma generators. In particular, the present invention relates to a plasma generator capable of producing a relatively long plasma plume or jet in open room air.

Non-thermal plasmas, or "cold plasmas", at or near atmospheric pressures have recently received increased attention because of their use in several emerging novel applications such as excimer light sources, the surface modifications of polymers, and the biological and chemical decontamination of media. Generating plasma in open room air adds the advantage of eliminating the need for an enclosure. Due to the abundant presence of oxygen, nitrogen, and moisture in air, reactive chemical species are produced. Additionally, since the whole process is carried out at atmospheric pressure, no costly and impractical vacuum equipment is necessary.

The plasma generator of this invention is capable of producing a relatively long plasma plume or jet in open room air. The generated plasma plume remains at room temperature and can be placed in contact with sensitive materials such as skin, flesh, paper, cloth, etc. without causing any damage. Another advantage of the plasma generator of this invention is its portability.

In various exemplary, non-limiting embodiments, the plasma generator, or "plasma pencil", comprises a cylindrical dielectric tube with a hole at the end where the plasma plume exits. Thus, the plasma pencil can be hand-held like a "pencil" and the generated plume can be applied to the sample under treatment.

In various exemplary embodiments, the plasma pencil can be used in applications requiring localized and precise plasma-treatment of materials that cannot withstand the harsh treatment of wet chemicals, high temperatures, or mechanical pressure. The plasma pencil provides a means for disinfection, sterilization, and/or precise cleaning of small surfaces, disinfection of skin or wounds, inactivation of dental bacteria, and the like. The medical field including dentistry is only one exemplary area of use of the plasma pencil.

Accordingly, this invention provides a plasma pencil, which can be used for sterilization, plasma-assisted wound healing, and/or cell detachment.

This invention separately provides a plasma pencil, which can be used for inactivation of dental bacteria, cleaning of dental caries, and/or sterilization of dental tools.

This invention separately provides a plasma pencil, which can be used for modification of surface properties (hydrophilic, oleophilic . . . ), for example, of materials such as polymers.

This invention separately provides a plasma pencil, which is portable, scalable, environmentally safe, easy to use, and operates at a relatively low temperature.

This invention separately provides a plasma pencil, which allows for the generation of a single cold plasma plume.

This invention separately provides a plasma pencil, which allows for the generation of multiple cold plasma plumes simultaneously.

This invention separately provides a plasma pencil, which generates one or more plasma plumes at room temperature.

This invention separately provides a plasma pencil, which generates one or more plasma plumes that can be placed in contact with sensitive materials such as skin, flesh, paper, cloth, etc. without causing any damage.

This invention separately provides a plasma pencil, which may be portable.

This invention separately provides a plasma pencil, which has a simplified design.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF THE PREFERRED EMBODIMENT

For simplicity and clarification, the design factors and operating principles of the plasma pencil according to this invention are explained with reference to various exemplary embodiments of a plasma pencil according to this invention. The basic explanation of the design factors and operating principles of the plasma pencil is applicable for the understanding, design, and operation of the plasma pencil of this invention.

Furthermore, it should be appreciated that, for simplicity and clarification, the embodiments of this invention will be described with reference to the plasma pencil comprising circular dielectric disks and a cylindrical dielectric tube. However, it should be appreciated that the dielectric disks and dielectric tube or tubes of this invention may comprise circular, oval, rectangular, square, pentagonal, or any other geometric shapes.

It should also be appreciated that the term "plasma pencil" is for basic explanation and understanding of the operation of the plasma pencils, methods, and apparatuses of this invention. Therefore, the term "plasma pencil" is not to be construed as limiting the plasma pencils, methods, and apparatuses of this invention.

Furthermore, where a range of values is provided, it is understood that every intervening value, between the upper and lower limit of that range and any other stated or intervening value in that stated range is encompassed within the invention. The upper and lower limits of these smaller ranges may independently be included in the smaller ranges and is also encompassed within the invention, subject to any specifically excluded limit in the stated range. Where the stated range includes one or both of the limits, ranges excluding both of those included limits are also included in the invention.

Figure 1:
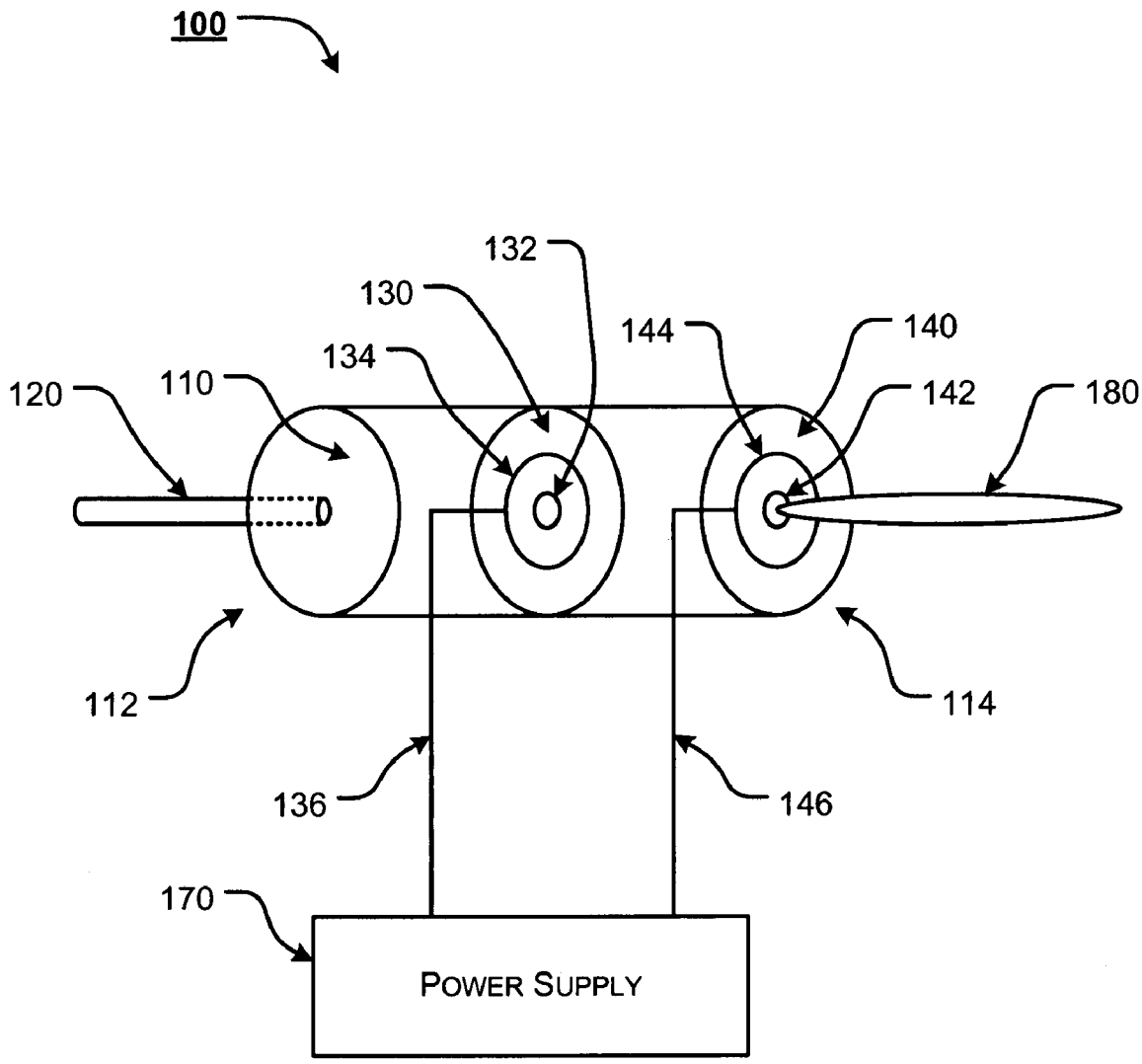
FIG. 1 shows a functional block diagram of a first illustrative, non-limiting embodiment of a plasma generator, or plasma pencil, according to this invention.

Turning now to FIG. 1, FIG. 1 shows a functional block diagram of a first illustrative, non-limiting embodiment of a plasma generator, or plasma pencil, according to this invention. As shown in FIG. 1, the plasma pencil 100 comprises a dielectric tube 110 having a first end 112 and a second end 114. At least one first electrode and one second electrode are placed or formed within or proximate a cavity of the dielectric tube 110.

The first electrode comprises a first dielectric disk 130 having a first dielectric aperture 132 formed therein. In various exemplary embodiments, the first dielectric aperture 132 is formed proximate a center of the first dielectric disk 130.

A first ring electrode 134 is attached or coupled to the first dielectric disk 130 so as to at least partially surround the first dielectric aperture 132. It should be appreciated that the first ring electrode 134 is attached or coupled to the first dielectric disk 130 such that the first ring electrode 134 does not obstruct the first dielectric aperture 132.

The first ring electrode 134 comprises an electrically conductive material, such as, for example, a metal. In various exemplary embodiments, the first ring electrode 134 may be embedded within the first dielectric disk 130.

In various exemplary embodiments, a diameter of the first ring electrode 134 is smaller than a diameter of the first dielectric disk 130, but is larger than a diameter of the first dielectric aperture 132.

The first ring electrode 134 is electrically coupled, via an electrical connection 136, to a power supply 170.

Similarly, the second electrode comprises a second dielectric disk 140 having a second dielectric aperture 142 formed therein. In various exemplary embodiments, the second dielectric aperture 142 is formed proximate a center of the second dielectric disk 140.

A second ring electrode 144 is attached or coupled to the second dielectric disk 140 so as to at least partially surround the second dielectric aperture 142. It should be appreciated that the second ring electrode 144 is attached or coupled to the second dielectric disk 140 such that the second ring electrode 144 does not obstruct the second dielectric aperture 142.

The second ring electrode 144 comprises an electrically conductive material, such as, for example, a metal. In various exemplary embodiments, the second ring electrode 144 may be embedded within the second dielectric disk 140.

In various exemplary embodiments, a diameter of the second ring electrode 144 is smaller than a diameter of the second dielectric disk 140, but is larger than a diameter of the second dielectric aperture 142.

The second ring electrode 144 is electrically coupled, via an electrical connection 146, to the power supply 170.

In various exemplary, non-limiting embodiments, at least a portion of the dielectric tube 110, the first dielectric disk 130, and/or the second dielectric disk 140 may be formed of glass, plexiglass, quartz, alumina, ceramic, or the like. However, it should be appreciated that the material that comprises each dielectric disk and the material that comprises the dielectric tube may be the same material or may be a different material. It should also be appreciated that the dielectric tube 110, the first dielectric disk 130, and/or the second dielectric disk 140 may be formed of multiple materials. Thus, it should be understood that the material or materials used to form the dielectric tube 110, the first dielectric disk 130, and/or the second dielectric disk 140 is a design choice based on the desired appearance, strength, and functionality of the plasma pencil 100.

In various exemplary, non-limiting embodiments, the first end 112 of the dielectric tube 110 is sealed or closed, but for a gas inlet 120. The first dielectric disk 130 is located within the cavity of the dielectric tube 110. The second dielectric disk 140 is located within the cavity of the dielectric tube 110, proximate the second end 114 of the dielectric tube 110. In various exemplary embodiments, the second dielectric disk 140 is located flush with the second end 114 of the dielectric tube 110.

In various exemplary, non-limiting embodiments, the distance that separates the first dielectric disk 130 from the second dielectric disk 140 is approximately 1-10 mm.

Once the plasma pencil 100 is constructed, a carrier gas (or mixture) is injected into the first end 112 of the dielectric tube 110, via the gas inlet 120. In various exemplary embodiments, the carrier gas (or mixture) is injected into the plasma pencil at a flow rate of approximately 1-10 ml/min. In various exemplary, non-limiting embodiments, the gas or gas mixtures may comprise helium, helium and oxygen, argon, nitrogen, air, or the like.

As the carrier gas (or mixture) is injected into the gas inlet 120, the gas flows through the cavity of the dielectric tube 110, through the first dielectric aperture 132 of the first dielectric disk 130, and finally through the second dielectric aperture 142 of the second dielectric disk 140.

When power is applied to the first ring electrode 134 and the second ring electrode 144, the injected gas breaks down and a plasma plume 180 is launched through the second dielectric aperture 142 of the second dielectric disk 140. The generated plasma plume 180 generally extends from the plasma pencil 100 in a direction that is parallel to the main axis of the plasma pencil 100. The generated plasma plume 180 is at room temperature and remains stable so long as the power is applied to the first ring electrode 134 and the second ring electrode 144 and the carrier gas is flowing.

In various exemplary, non-limiting embodiments, the power supply 170 can supply Alternating Current (AC), Radio Frequency (RF) power, or regulated voltage pulses of varying frequencies to the first ring electrode 134 and the second ring electrode 144.

In various exemplary, non-limiting embodiments, the power supply 170 supplies between 1-20 watts of power to the first ring electrode 134 and the second ring electrode 144. It should be understood that, in various exemplary embodiments, the power supply 170 may supply up to several hundred watts of power to the first ring electrode 134 and the second ring electrode 144, based on the desired strength, functionality, and/or size of the generated plasma plume 180 or the plasma pencil 100.

In various exemplary embodiments, the plasma plume 180 may measure 2 inches or more, while the width of the plasma plume 180 is generally determined by the diameter or size of the second dielectric aperture 142. In various exemplary embodiments, the diameter of the second dielectric aperture 142 may be approximately 1 mm to a few millimeters.

Figure 2:
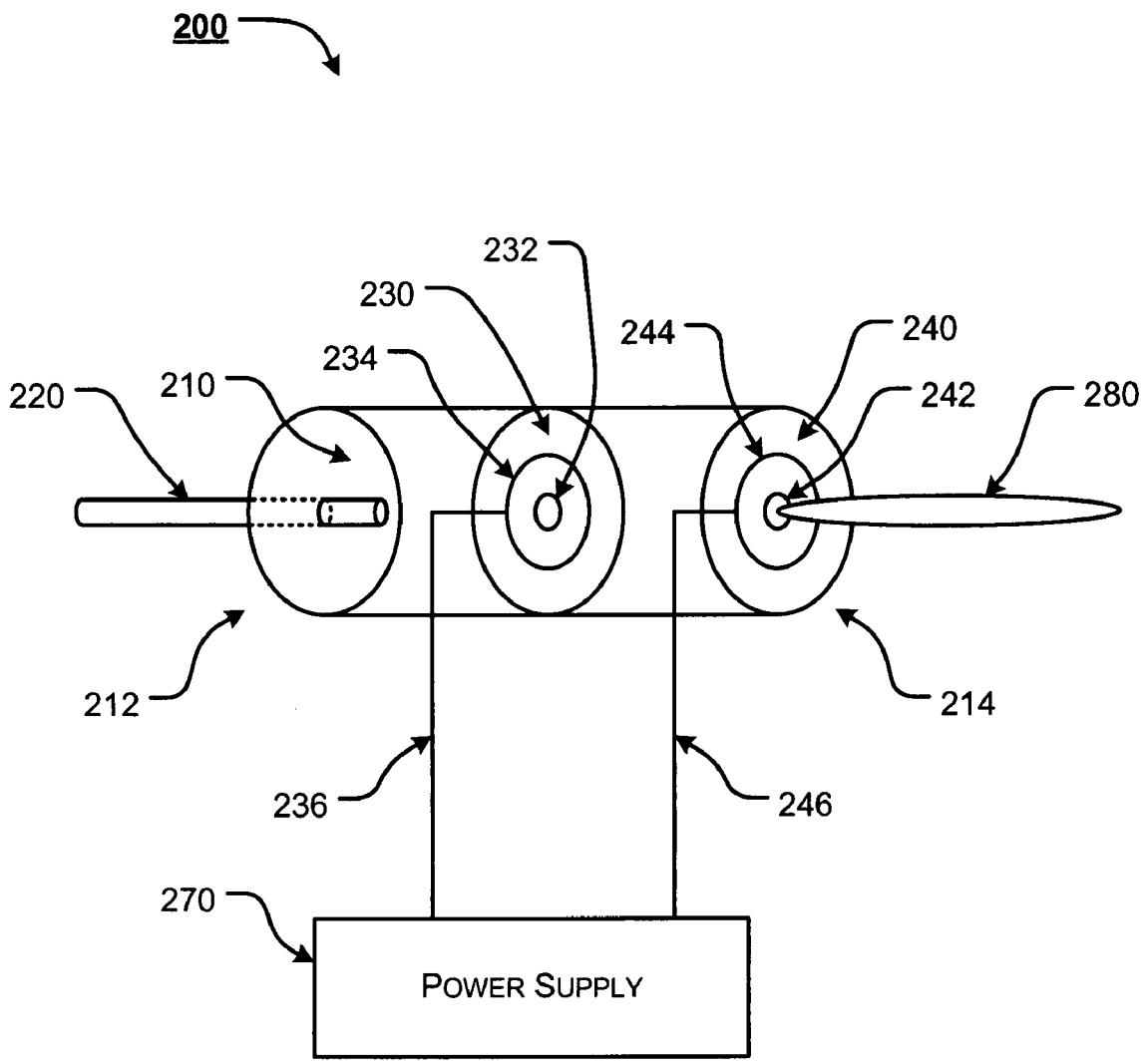
FIG. 2 shows a functional block diagram of a second illustrative, non-limiting embodiment of a plasma generator, or plasma pencil, according to this invention.

FIG. 2 shows a functional block diagram of a second illustrative, non-limiting embodiment of a plasma generator, or plasma pencil, according to this invention. As shown in FIG. 2, the plasma pencil 200 comprises a dielectric tube 210 having a first end 212 and a second end 214. In various exemplary, non-limiting embodiments, the first end 212 of the dielectric tube 210 is sealed or closed, but for a gas inlet 220.

At least one first electrode and one second electrode are placed or formed within or proximate a cavity of the dielectric tube 210. The first electrode comprises a first dielectric disk 230 having a first dielectric aperture 232 formed therein and a first ring electrode 234 that at least partially surrounds the first dielectric aperture 232. The first ring electrode 234 is electrically coupled, via an electrical connection 236, to a power supply 270.

Similarly, the second electrode comprises a second dielectric disk 240 having a second dielectric aperture 242 formed therein and a second ring electrode 244 that at least partially surrounds the second dielectric aperture 242. The second ring electrode 244 is electrically coupled, via an electrical connection 246, to the power supply 270.

It should be understood that each of these elements, if included, corresponds to and operates similarly to the dielectric tube 110, the first end 112, the second end 114, the gas inlet 120, the first dielectric disk 130, the first dielectric aperture 132, the first ring electrode 134, the electrical connection 136, the second dielectric disk 140, the second dielectric aperture 142, the second ring electrode 144, the electrical connection 146, and the power supply 170, as described above with reference to the plasma pencil 100 of FIG. 1.

However, as shown in FIG. 2, the gas inlet 220 includes a gas delivery tube that extends into the cavity of the dielectric tube 210. In various exemplary embodiments, the inner diameter of gas delivery tube is approximately equal to the diameter of the first dielectric aperture 232 and/or the second dielectric aperture 242. In various other exemplary embodiments, the inner diameter of gas delivery tube is larger than the diameter of the first dielectric aperture 232 and/or the second dielectric aperture 242.

Figure 3:
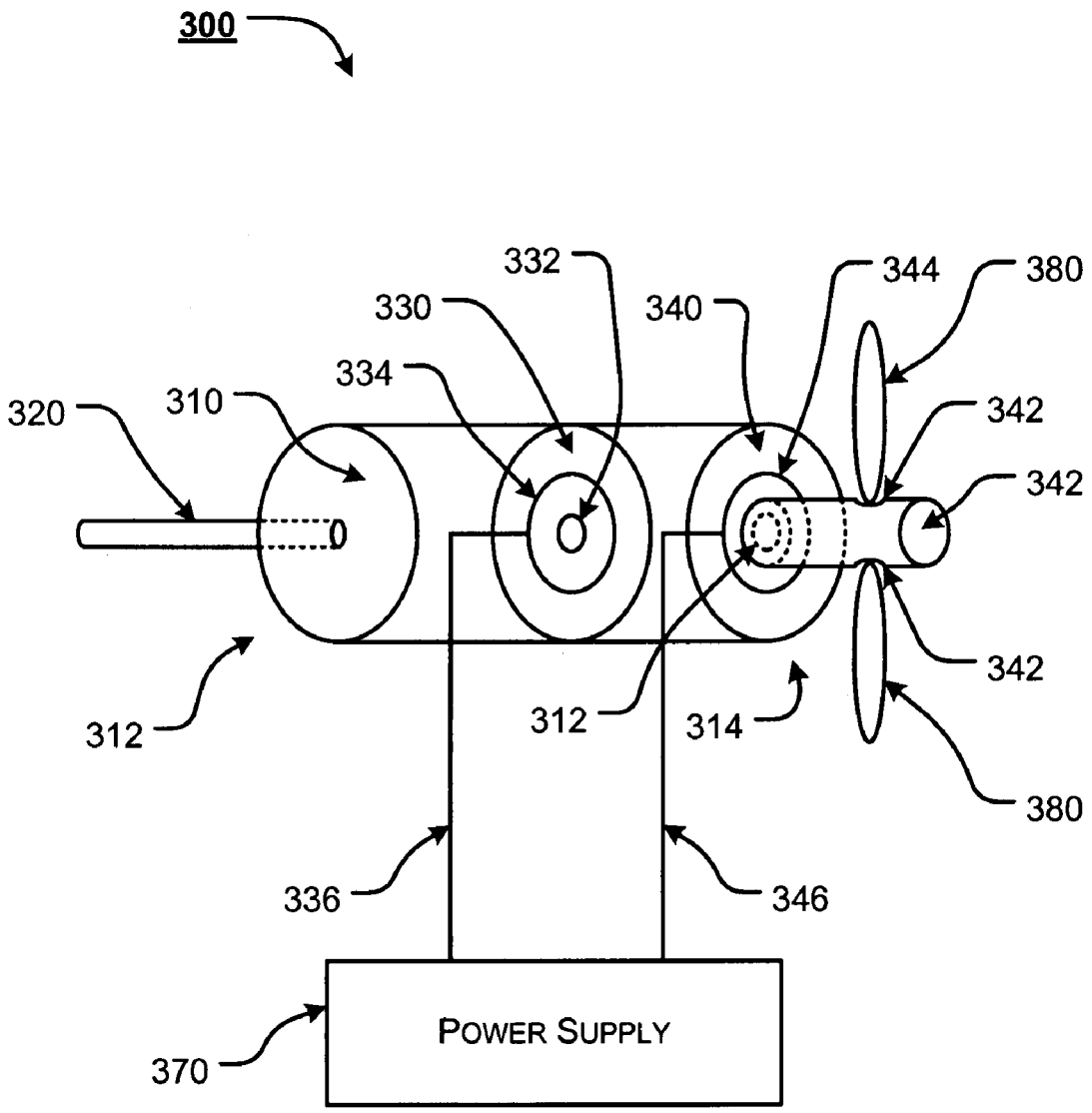
FIG. 3 shows a functional block diagram of a third illustrative, non-limiting embodiment of a plasma generator, or plasma pencil, according to this invention.

FIG. 3 shows a functional block diagram of a third illustrative, non-limiting embodiment of a plasma generator, or plasma pencil, according to this invention. As shown in FIG. 3, the plasma pencil 300 comprises a dielectric tube 310 having a first end 312 and a second end 314. In various exemplary, non-limiting embodiments, the first end 312 of the dielectric tube 310 is sealed or closed, but for a gas inlet 320.

At least one first electrode and one second electrode are placed or formed within or proximate a cavity of the dielectric tube 310. The first electrode comprises a first dielectric disk 330 having a first dielectric aperture 332 formed therein and a first ring electrode 334 that at least partially surrounds the first dielectric aperture 332. The first ring electrode 334 is electrically coupled, via an electrical connection 336, to a power supply 370.

Similarly, the second electrode comprises a second dielectric disk 340 having a second dielectric aperture 342 formed therein and a second ring electrode 344 that at least partially surrounds the second dielectric aperture 342. The second ring electrode 344 is electrically coupled, via an electrical connection 346, to the power supply 370.

It should be understood that each of these elements, if included, corresponds to and operates similarly to the dielectric tube 110, the first end 112, the second end 114, the gas inlet 120, the first dielectric disk 130, the first dielectric aperture 132, the first ring electrode 134, the electrical connection 136, the second dielectric disk 140, the second dielectric aperture 142, the second ring electrode 144, the electrical connection 146, and the power supply 170, as described above with reference to the plasma pencil 100 of FIG. 1.

Optionally, the plasma pencil 300 may include a gas delivery tube that extends from the gas inlet 320 into the cavity of the dielectric tube 310, as described above, with reference to FIG. 2.

However, as shown in FIG. 3, the plasma pencil 100 includes a dielectric applicator tube 346 that extends from the second dielectric aperture 342 of the second dielectric disk 340. In various exemplary embodiments, the diameter of the applicator tube 346 is larger than the diameter of the second dielectric aperture 342, but equal to or smaller than the diameter of the second ring electrode 344.

In various exemplary embodiments, the dielectric applicator tube 346 has a closed distal end and includes a plurality of apertures 348 formed around its circumference at locations where desired plasma plumes 380 are to extend from the dielectric applicator tube 346. In various exemplary embodiments, the diameter of the apertures 348 is approximately 1-3 mm.

When the plasma pencil 300 is in use, plasma plumes 380 extend from each of the apertures 348. It should be appreciated that these plasma plumes 380 may extend in a direction perpendicular to the main axis of the plasma pencil 300. Alternatively, the plasma plumes 380 may extend in a direction that is at an obtuse angle to the main axis of the plasma pencil 300. In still other exemplary embodiments, the plasma plumes 380 may extend in a direction that is at an acute angle to the main axis of the plasma pencil 300.

Figure 4:
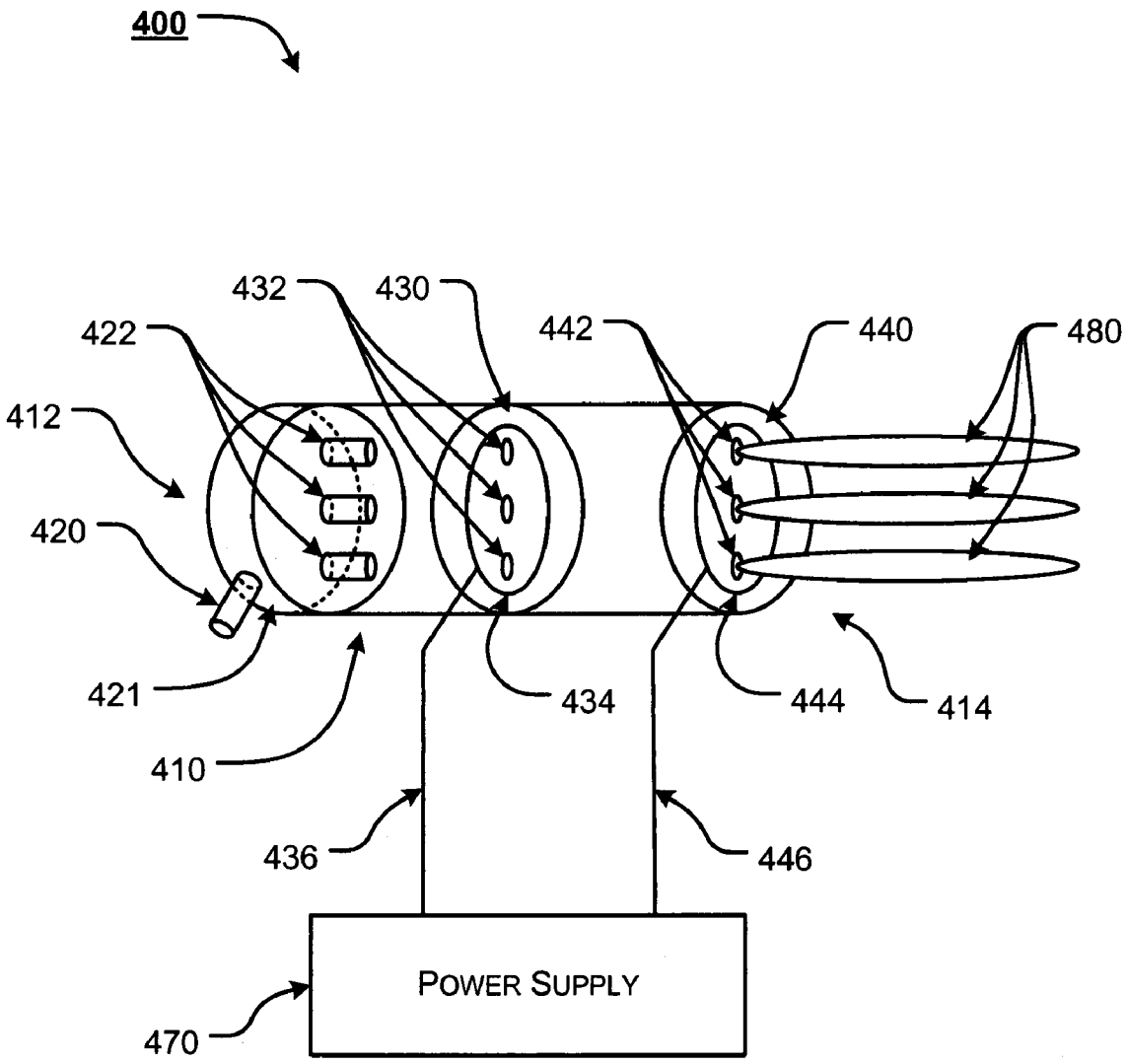
FIG. 4 shows a functional block diagram of a fourth illustrative, non-limiting embodiment of a plasma generator, or plasma pencil, according to this invention.

FIG. 4 shows a functional block diagram of a fourth illustrative, non-limiting embodiment of a plasma generator, or plasma pencil, according to this invention. As shown in FIG. 4, the plasma pencil 400 comprises a dielectric tube 410 having a first end 412 and a second end 414. In various exemplary, non-limiting embodiments, the first end 412 of the dielectric tube 410 is sealed or closed, but for a gas inlet 420.

At least one first electrode and one second electrode are placed or formed within or proximate a cavity of the dielectric tube 410. The first electrode comprises a first dielectric disk 430 having at least one first dielectric aperture 432 formed therein and a first ring electrode 434 that at least partially surrounds the at least one first dielectric aperture 432. The first ring electrode 434 is electrically coupled, via an electrical connection 436, to a power supply 470.

Similarly, the second electrode comprises a second dielectric disk 440 having at least one second dielectric aperture 442 formed therein and a second ring electrode 444 that at least partially surrounds the at least one second dielectric aperture 442. The second ring electrode 444 is electrically coupled, via an electrical connection 446, to the power supply 470.

It should be understood that each of these elements, if included, corresponds to and operates similarly to the dielectric tube 110, the first end 112, the second end 114, the gas inlet 120, the first dielectric disk 130, the first dielectric aperture 132, the first ring electrode 134, the electrical connection 136, the second dielectric disk 140, the second dielectric aperture 142, the second ring electrode 144, the electrical connection 146, and the power supply 170, as described above with reference to the plasma pencil 100 of FIG. 1.

Optionally, the plasma pencil 400 may include at least one dielectric applicator tube (not shown) that extends from one, from each, or collectively from all of the at least one apertures 442 of the second dielectric disk 440, as described above, with reference to FIG. 3.

However, as shown in FIG. 4, a dielectric chamber wall 423 is included within the cavity of the dielectric tube 410. The chamber wall 423 includes a plurality of gas inlet apertures 422 and creates a gas regulating chamber 421 within the cavity of the dielectric tube 410. In various exemplary embodiments, each gas inlet aperture 422 includes a gas delivery tube that extends from the chamber wall 423 towards the second end 414. The gas delivery tubes, if included, direct the flow of gas towards the apertures in the first dielectric disk 430 and the second dielectric disk 440.

The gas regulating chamber 421 allows gas from the gas inlet 420 to be more evenly distributed to the plurality of gas inlet apertures 422.

The number, shape, and size of the aperture(s) 432 and the aperture(s) 442 is a design choice based on the desired number, shape, and size of the generated plasma plumes 480. The first ring electrode 434 and the second ring electrode 444 may be formed so as to surround the aperture(s) 432 and the aperture(s) 442, respectively, without obstructing them. Alternatively, the first ring electrode 434 and the second ring electrode 444 may be formed so as to separately surround each of the aperture(s) 432 and the aperture(s) 442, respectively, without obstructing them.

While this invention has been described in conjunction with the exemplary embodiments outlined above, it is evident that many alternatives, modifications, and variations will be apparent to those skilled in the art. For example, the plasma pencil of this invention may comprise a plurality of dielectric disks spaced apart in the dielectric tube. Likewise, the gas regulating chamber, as described above, with reference to FIG. 4, may optionally be included in any of the exemplary embodiments of the plasma pencil described herein.

Such adaptations and modifications should and are intended to be comprehended within the meaning and range of equivalents of the disclosed exemplary embodiments. It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A plasma generator, comprising:

a dielectric tube having a first end and a second end, wherein the first end is sealed;

a gas inlet formed proximate the first end of the dielectric tube;

at least one first dielectric disk located within a cavity of the dielectric tube, wherein the first dielectric disk includes at least one first dielectric aperture formed therein;

a first ring electrode coupled to the first dielectric disk such that the first ring electrode at least partially surrounds the at least one first dielectric aperture, wherein the first ring electrode is electrically coupled, via an electrical connection, to a power supply;

at least one second dielectric disk located proximate the second end of the dielectric tube, wherein the second dielectric disk includes at least one second dielectric aperture formed therein such that a plasma plume may extend from the at least one second dielectric aperture;

a second ring electrode coupled to the second dielectric disk such that the second ring electrode at least partially surrounds the at least one second dielectric aperture, wherein the second ring electrode is electrically coupled, via an electrical connection, to the power supply.

2. The plasma generator of claim 1, wherein the gas inlet is formed through the first end of the dielectric tube such that the first end is sealed, but for the gas inlet.

3. The plasma generator of claim 1, wherein the first dielectric aperture is formed proximate a center of the first dielectric disk.

4. The plasma generator of claim 1, wherein the first ring electrode comprises an electrically conductive material.

5. The plasma generator of claim 1, wherein the first ring electrode is embedded within the first dielectric disk.

6. The plasma generator of claim 1, wherein a diameter of the first ring electrode is smaller than a diameter of the first dielectric disk.

7. The plasma generator of claim 1, wherein the second dielectric aperture is formed proximate a center of the second dielectric disk.

8. The plasma generator of claim 1, wherein the second ring electrode comprises an electrically conductive material.

9. The plasma generator of claim 1, wherein the second ring electrode is embedded within the second dielectric disk.

10. The plasma generator of claim 1, wherein a diameter of the second ring electrode is smaller than a diameter of the second dielectric disk.

11. The plasma generator of claim 1, wherein the second dielectric disk is located flush with the second end 114 of the dielectric tube.

12. The plasma generator of claim 1, wherein the dielectric tube comprises glass, plexiglass, quartz, alumina, ceramic, or an equivalent.

13. The plasma generator of claim 1, wherein the first dielectric disk comprises glass, plexiglass, quartz, alumina, ceramic, or an equivalent.

14. The plasma generator of claim 1, wherein the second dielectric disk comprises glass, plexiglass, quartz, alumina, ceramic, or an equivalent.

15. The plasma generator of claim 1, wherein the first dielectric disk is spaced apart from the second dielectric disk by approximately 1-10 mm.

16. The plasma generator of claim 1, wherein the diameter of the dielectric aperture is approximately 1-5 mm.

17. The plasma generator of claim 1, wherein the plasma generator includes a dielectric applicator tube that extends from the second dielectric aperture, wherein the dielectric applicator tube includes a plurality of apertures formed such that a plurality of plasma plumes may extend from the dielectric applicator tube.

18. The plasma generator of claim 17, wherein the apertures are formed around a circumference of the dielectric applicator tube.

19. The plasma generator of claim 17, wherein the plasma plumes extend from the plurality of apertures in a direction that is substantially perpendicular to the main axis of the plasma generator.

20. The plasma generator of claim 1, wherein the plasma plumes extend from the plurality of apertures in a direction that is at an obtuse angle to the main axis of the plasma generator.

21. The plasma generator of claim 1, wherein the plasma plumes extend from the plurality of apertures in a direction that is at an acute angle to the main axis of the plasma generator.

22. A method for producing a plasma plume, the plasma generator, comprising:

a dielectric tube having a first end and a second end, wherein the first end is sealed, but for a gas inlet;

at least one first dielectric disk located within a cavity of the dielectric tube, wherein the first dielectric disk includes at least one first dielectric aperture formed therein;

a first ring electrode coupled to the first dielectric disk such that the first ring electrode at least partially surrounds the at least one first dielectric aperture, wherein the first ring electrode is electrically coupled, via an electrical connection, to a power supply;

at least one second dielectric disk located proximate the second end of the dielectric tube, wherein the second dielectric disk includes at least one second dielectric aperture formed therein such that a plasma plume may extend from the at least one second dielectric aperture;

a second ring electrode coupled to the second dielectric disk such that the second ring electrode at least partially surrounds the at least one second dielectric aperture, wherein the second ring electrode is electrically coupled, via an electrical connection, to the power supply;

the method comprising:

injecting a carrier gas into the gas inlet, wherein the carrier gas flows through the at least one first dielectric aperture and the at least one second dielectric aperture;

applying power to the first ring electrode, via the electrical connection, from the power supply;

applying power to the second ring electrode, via the electrical connection, from the power supply; and producing a plasma plume from the at least one second dielectric aperture.

23. The method for producing a plasma plume of claim 22, wherein the carrier gas comprises helium, helium and oxygen, argon, nitrogen, air, or an equivalent.

* * * * *

UNITED STATES PATENT AND TRADEMARK OFFICE

CERTIFICATE OF CORRECTION

PATENT NO. : 7,719,200 B2
APPLICATION NO. : 11/885840
DATED : May 18, 2010
INVENTOR(S) : Mounir Laroussi It is certified that error appears in the above-identified patent and that said Letters Patent is hereby corrected as shown below:

Please insert the following new paragraph(s) at Col. 1, Line 2, before the "Cross Reference to Related Applications":

--Statement of Government Interest

This invention was made with United States Government support under Award No. F49620-03-1-0325 awarded by the United States Air Force Office of Scientific Research (AFOSR). The United States Government has certain rights in this invention.--

Signed and Sealed this

Sixth Day of July, 2010

David J. Kappos

David J. Kappos
*Director of the United States Patent and Trademark Office*